US012286860B2

(12) United States Patent
Stam et al.

(10) Patent No.: US 12,286,860 B2
(45) Date of Patent: Apr. 29, 2025

(54) DOWNHOLE SEAL AND METHOD OF SETTING A DOWNHOLE SEAL

(71) Applicant: Ruma Products B.V., Hoogeveen (NL)

(72) Inventors: Walter Stam, Aalsmeer (NL); Evert Jonathan Van Den Ham, Wijk en Aalburg (NL); Timotheus Kees Theodorus Wolterbeek, Haarlem (NL); Erik Kerst Cornelissen, Haarlem (NL)

(73) Assignee: RUMA PRODUCTS B.V. (NL)

( * ) Notice: Subject to any disclaimer, the term of this patent is extended or adjusted under 35 U.S.C. 154(b) by 0 days.

(21) Appl. No.: 18/017,545

(22) PCT Filed: Jul. 22, 2021

(86) PCT No.: PCT/EP2021/070572
§ 371 (c)(1),
(2) Date: Jan. 23, 2023

(87) PCT Pub. No.: WO2022/018219
PCT Pub. Date: Jan. 27, 2022

(65) Prior Publication Data

US 2023/0265736 A1 Aug. 24, 2023

(30) Foreign Application Priority Data

Jul. 24, 2020 (EP) ..... 20187698
Jun. 29, 2021 (EP) ..... 21182354

(51) Int. Cl.
*E21B 33/12* (2006.01)

(52) U.S. Cl.
CPC ..... *E21B 33/1208* (2013.01)

(58) Field of Classification Search
CPC ..... E21B 33/1208
See application file for complete search history.

(56) References Cited

U.S. PATENT DOCUMENTS

| | | | | |
|---|---|---|---|---|
| 9,556,703 | B2 * | 1/2017 | Daou | C09K 8/035 |
| 10,125,302 | B2 * | 11/2018 | Mishra | C04B 26/06 |
| 2014/0090844 | A1 | 4/2014 | Daou et al. | |
| 2014/0090895 | A1 | 4/2014 | Daou et al. | |
| 2019/0316025 | A1 | 10/2019 | Sherman et al. | |

OTHER PUBLICATIONS

International Search Report and the Written Opinion of the International Search Authority—The European Patent Office mailed Sep. 30, 2021 for PCT/EP2021/070572, 9 pages.
International Preliminary Report on Patentability mailed Jan. 24, 2023 from the World Intellectual Property Organization for PCT/EP2021/070572, 7 pages.
Leung, Dennis Y.C., et al., "An Overview of Current Status of Carbon Dioxide Capture and Storage Technologies", Renewable and Sustainable Energy Reviews, 39, 2014, pp. 426-443.

* cited by examiner

*Primary Examiner* — Catherine Loikith
(74) *Attorney, Agent, or Firm* — Jackson Walker LLP

(57) ABSTRACT

A downhole seal is proposed which has a $CO_2$ swellable elastomer which swells when in contact with $CO_2$. The downhole seal can be set by installing a downhole seal comprising a $CO_2$ swellable elastomer in a downhole location within a borehole, and exposing the downhole seal to contact with $CO_2$ after installing, whereby the $CO_2$ causes the downhole seal to swell.

16 Claims, 2 Drawing Sheets

DOWNHOLE SEAL AND METHOD OF SETTING A DOWNHOLE SEAL

FIELD OF THE INVENTION

The present invention relates to a downhole seal, for application in subsurface storage of carbon dioxide, and a method of setting such a downhole seal.

BACKGROUND TO THE INVENTION

Carbon capture and storage (CCS) technologies have sparked major interest globally as one of the options to achieve reduction of carbon dioxide ($CO_2$) levels in the atmosphere. Depleted oil and gas reservoirs, coal formations, and particularly saline formations (deep underground porous reservoir rocks saturated with brackish water or brine), can be used for storage of $CO_2$. The injection of $CO_2$ in deep geological formations uses technologies that have been developed for, and applied by, the oil and gas industry. Well-drilling technology, injection technology, computer simulation of storage reservoir dynamics and monitoring methods can potentially be adapted from existing applications to meet the needs of geological storage.

Chapter 5 of the IPCC Special Report on Carbon Dioxide Capture and Storage, first published in 2005, discusses aspects of underground geological storage of carbon dioxide. At typical storage depths, below about 800-1000 m, supercritical $CO_2$ has a liquid-like density that provides the potential for efficient utilization of underground storage space in the pores of sedimentary rocks. Potential risks to humans and ecosystems from geological storage may arise from leaking injection wells, abandoned wells, leakage across faults and ineffective confining layers.

A recent review paper "An overview of current status of carbon dioxide capture and storage technologies" by Dennis Y. C. Leung et al. published in Renewable and Sustainable Energy Reviews Vol. 39 (2014), pages 426-443, confirms that one of the important aspects for geological storage is the potential leakage of the stored $CO_2$, which would impair the effectiveness of the $CO_2$ confinement and eventually could lead to serious consequences.

The present disclosure addresses avoiding and remedying of potential leaks, particularly within boreholes (wells).

SUMMARY OF THE INVENTION

In one aspect, there is provided downhole seal comprising a $CO_2$ swellable elastomer which swells when in contact with $CO_2$.

In another aspect, there is provided a method of setting a downhole seal, comprising installing a downhole seal comprising a $CO_2$ swellable elastomer in a downhole location within a borehole and exposing the downhole seal to contact with $CO_2$ after said installing, whereby the $CO_2$ causes the downhole seal to swell.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION OF THE INVENTION

Figure 1:
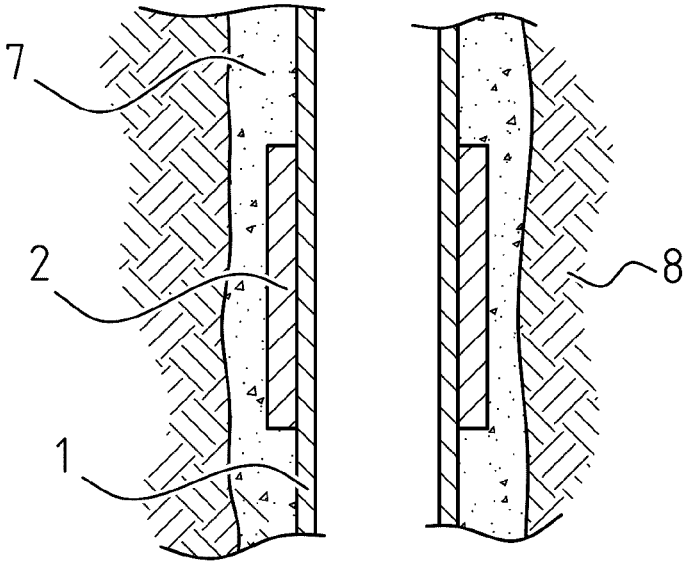
FIG. 1 schematically shows a cross sectional view of a downhole elastomer seal on a wellbore tubular cemented in a wellbore in the Earth.

The person skilled in the art will readily understand that, while the detailed description of the invention will be illustrated making reference to one or more embodiments, each having specific combinations of features and measures, many of those features and measures can be equally or similarly applied independently in other embodiments or combinations.

The present description describes $CO_2$ swellable elastomer seal, which may for example be used for downhole pressure isolation in a carbon capture storage well. Such well typically contains a cased section in which a casing is cemented in the wellbore. When $CO_2$ is introduced into a wellbore, the well may cool down. As a result of the temperature decrease, small leaks may be induced, typically at an interface between casing and cement where the cement comes into contact with the casing.

The $CO_2$ swellable seal can be a sleeve, packer, o-ring or any other type of elastomeric seal that is known to be used in well equipment.

Other sealbores, such as seal areas on a sub surface safety valve, liner hanger, packer and wellhead, may also benefit from $CO_2$ swellable elastomeric seals. When this $CO_2$ swellable seal comes into contact with $CO_2$ it will increase in volume (swell) as a result of $CO_2$ uptake. The swelling may cause the seal to increase positive pressure against the seal bore or any other type of seal interface and thereby creating a positive pressure/fluid tight seal.

In one group of embodiments, the $CO_2$ swellable seal may comprise a halogenated elastomer. Preferred halogenated elastomers include fluorinated elastomers, for example of the FKM family (ASTM International standard D1418. It is equivalent to FPM by ISO/DIN 1629 standard), which typically contain vinylidene fluoride as a monomer and/or may contain other fluorine compounds such as, for example, fluorinated vinyl ether, hexafluoropropylene, or tetrafluoroethylene. More preferred, however, are perhalogenated elastomers, particularly perfluoroelastomers, such as FFKMs (equivalent to FFPMs), for example. Halogenated elastomers (which have increased levels of polarized chemical groups) have been found to yield favorable influence on swellability.

Alternatively, in another group of embodiments, the $CO_2$ swellable seal may comprise non-fluorinated elastomeric products, which may absorb $CO_2$ and thereby increase in volume. Examples include M-class rubbers defined in the ASTM International standard D1418, including EPDM (ethylene propylene diene monomer rubber), or (hydrogenated) nitrile rubbers, including nitrile butadiene rubber (NBR) and hydrogenated nitrile butadiene rubber (HNBR).

Regardless of which group of embodiments is employed, the $CO_2$ swellable seal may also be used in combination with other type of swellable elastomeric seals that swell upon contact with formation water or gas condensate.

Under typical temperature and pressure conditions under which $CO_2$ is stored in the subsurface environments, which generally exceed 31.1° C. and 73.8 bar, it can be assumed that the $CO_2$ is in the supercritical (SC) phase. In this phase, the viscosity is similar to a gas, but in terms of solubility behavior, it resembles a liquid. For thermoplastic polymers, exposure to supercritical $CO_2$ is known to lead to weight loss (due to loss of monomers, plasticizers, stabilizers) and plasticization. The chemical composition of the elastomer is relevant for the swelling behavior and stability of the elastomer in contact with (supercritical) $CO_2$, since some chemical groups have much more interaction with $CO_2$ than others. For example, a typical EPDM elastomer, which has mainly C—H and $CH_3$ chemical groups, has relatively little interaction with $CO_2$, whereas fluorinated elastomers such as FKM have much more interaction with $CO_2$ because of the fluorine containing chemical groups. Similar effects may be expected for other halogens.

Considerations to select $CO_2$ swellable elastomers, which adequately swell when in contact with $CO_2$ and perform reliably as a downhole seal, may include:

(1) High-temperature stability—The temperature stability should be sufficient to withstand temperatures which are governed by geothermal factors. For general applicability, the elastomer should be stable up to about 160° C., but somewhat lower temperatures may be applicable on certain sites.

(2) Low-temperature stability—The elastomer should preferably not be used as downhole seal at any temperature lower than the glass transition temperature (Tg) of the elastomer, since the elastomer would then start to lose its soft and swelling (rubber-like) properties. Although most CCS studies indicate maximum temperature requirements for materials, a few notions are made regarding low-temperature stability as well. Physical phenomena such as the Joule-Thomson effect may cause the actual temperature to go down to well below zero degrees Celsius. While actual temperatures may go down to as low as −70° C., prolonged exposure to such extreme temperatures may be avoided by strategic positioning of the $CO_2$ swellable elastomers downhole In practice, the elastomer should preferably be able to withstand a temperature as low as −20° C., for low temperature elastomer service, and stability at temperatures below −20° C. can be extra advantageous as it increases the window of operability.

(3) Chemical compatibility—For CCS, chemical contaminations are often assumed to be comparable to concentrations noted for enhanced oil recovery (EOR). Besides $CO_2$, chemical compatibility with one or more of: nitrogen ($N_2$), hydrocarbons (HC), water and low concentrations of hydrogen sulfide ($H_2S$), may be recommended. In specific case of elastomers in physical contact with concrete cement, alkaline conditions can occur as well. Alkaline conditions generally correspond to pH exceeding 7.0; however, high alkaline conditions with pH>11 are not uncommon for pore fluids in for example Portland cement.

(4) $CO_2$ permeability—Permeability of $CO_2$ should be sufficiently low, to assure the sealing levels that are desired. Acceptable permeability depends on externally determined requirements.

(5) $CO_2$ dissolution—The swelling capacity of elastomers in $CO_2$ is a crucial parameter for the function of the downhole seal. This property is mainly dictated by dissolution of $CO_2$ in the elastomer.

(6) diffusivity—There is a trade-off between sealing properties and resistance against explosive decompression (ED) properties. High diffusivity helps to prevent rupture of the elastomer in case of an ED event. The lower the diffusivity that can be afforded in view of ED risk, the higher the available swellability. In absence of ED, a low diffusivity is the best outcome to maximize swellability. A combination of strong swelling and high diffusivity is unlikely to be suitable, as permeability (the product of dissolution and diffusion) would be high and the elastomer would have low sealing value as a result. In other words, only limited swelling is allowed in combination with high $CO_2$ diffusivity (or vice versa) in elastomers to prevent high $CO_2$ permeability and rupture.

Table 1 shows compatibility data for selected elastomers derived from publicly available sources.

TABLE 1

| Abbr. name | Chemistry | Low Temp. (° C.) | High Temp. (° C.) | Stability threats |
|---|---|---|---|---|
| CR | C—Cl | −35 | 130 | $H_2S$, HC, steam |
| CSM | R-S-R | −35 | 130 | $H_2S$, HC, steam |
| EPDM | C—H; C—$H_3$ | −45 | 170 | HC |
| FEPM | C—F; C—$H_3$ | 0 | 230 | HC |
| FFKM | C—F; C—H; C—Cl; R-S-R | −25 to 0 | 300 | |
| FKM | C—F; C—H; C—Cl; R-S-R | −40 to 0 | 200 | $H_2S$, alkaline, steam |
| HNBR | C—C≡N | −30 | 170 | $H_2S$, HC, alkaline |
| NBR | C—C≡N | −30 | 125 | $H_2S$, HC, steam |
| Silicone | O—Si—O | −50 | 300 | $H_2S$, HC, steam |
| TWT | S—H; R-S-R | −45 | 105 | unknown |

CR stands for chloroprene rubber (neoprene); CSM stands for chlorosulfonated polyethylene (Hypalon); FEPM stands for Tetrafluoroethylene propylene (Aflas); TWT stands for polythiol. CR, CSM, NBR, and TWT would generally score low on the high-temperatures stability for most downhole sealing applications.

FFKM is considered to be the best selection based on chemical resistance. A major part of the composition of this polymer is the equivalent of fluorinated polymers, and inert to many chemicals. The low-temperature stability is however a weak point. Special grades would be required to drop below 0° C.

The basic chemistry of FKM is related to FFKM, but additional (cheaper) groups are present. This compromises resistance against the steam, $H_2S$ and alkaline (high pH). Special grades of FKM offer low-temperature stability down to −40° C., whereas normal grades are usable down to 0° C.

Other elastomers which could be considered from a chemical compatibility point of view are HNBR, which is a high temperature stable variant of the nitrile elastomer with equal low temperature properties. However, for both nitrile elastomers, strong alkaline environment would be problematic as well as high concentration of aromatic hydrocarbons. And most of all, $H_2S$ could have a dramatic effect on this nitrile elastomer due to hydrolysis.

Silicones offer an interesting combination from a temperature stability point of view. They exhibit the lowest glass transition temperature of all elastomers—offering flexible materials at low temperature—while the high-temperature stability up to 300° C. is impressive as well. However, the nature of the chemistry makes it less stable against steam, hydrocarbons and $H_2S$.

EPDM could be considered as well, though the hydrocarbon resistance is relatively low. EPDM would not be suitable if the HC content would exceed 4% by volume. In specific cases of CCS, where no presence of hydrocarbons is expected, EPDM should however be considered because of its high resistance to other chemicals involved for CCS. In addition, the lack of fluorine groups lowers the glass transition temperature, implying that EPDM ranks high in terms of low temperature applicability. Noteworthy, EPDM is one of the most cost-effective elastomers.

FEPM is a compromise between EPDM and fluorinated elastomers, directly reflecting its composition. Depending on field conditions, this is the only elastomer listed which has issues regarding low-temperature stability. If applied, safety margins for low-temperature stability will be smaller as compared to other candidates.

Table 2 shows some permeability values at standard temperature and pressure (298 K/101325 Pa) derived from publicly available sources. The values for HNBR are estimated based on data known for NBR.

TABLE 2

| Abbr. name | $CO_2$ permeability ($cm^3 \cdot cm^{-1}$) | Air permeability ($cm^3 \cdot cm^{-1}$) |
|---|---|---|
| EPDM | 85 | 7.9 |
| FEPM | Unknown | Unknown |
| FFKM | 2.5 | 0.3 |
| FKM | 5.0 | 0.1 |
| HNBR | 10 | 0.1 |
| Silicone | $1.3 \cdot 10^3$ | |

Despite the favorable stability temperature range, it would appear that silicone proves to be unsuitable for sealing purposes due to the high number for $CO_2$ permeability.

EPDM has a significantly lower permeability than silicone elastomers, but it remains a more than a factor 10 higher than fluorinated elastomer such as FKM. No values could be found for FEPM, but many reports can be found indicating 'low' gas permeability. Based on the chemistry used, the permeability will probably resemble FKM. The difference between FKM and FFKM is very small and can be neglected, especially since several grades of FKM are available. Hence, in terms of permeability, FFKM, FKM and HNBR would be preferred. EPDM could be considered, depending on system requirements.

Without wishing to be bound by theory, the dissolution of $CO_2$ in elastomers may be affected by molecular interactions, which may depend on electronegativity of the C═O bond of $CO_2$ on the one hand, and polymer side groups (e.g. C—H, C—F or C—Cl) on the other hand. Hence, more polar side groups present in the elastomer might have a strong interaction with the $CO_2$ molecules present. These molecular interactions may explain that the permeability could increase with temperature. In addition, there is evidence of a strong correlation between the (apparent) crosslink density and the permeability and dissolution. Since the number of crosslinks may be affected by aging (leading to fewer crosslinks), the properties of elastomers may chance over time. Due to the reduction of crosslinks, for HNBR it was shown that the $CO_2$ barrier properties increase, while the dissolution of $CO_2$ reduces. A lower degree of crosslinks may thus reduce swellability.

Table 3 shows relative swellability (in %) of selected elastomers in contact with $CO_2$ at various conditions as can be found in publicly available sources.

TABLE 3

| $CO_2$ phase (P[bar]/T[° C.]) | EPDM | FEPM | FKM | FFKM | HNBR |
|---|---|---|---|---|---|
| Gas (50/23) | 9% | 37% | 30% | — | 16% |
| Gas (50/50) | 10% | — | — | — | — |
| SC (150/110) | 15% | — | — | — | — |
| SC (270/100) | 10% | — | — | 57% | 63% |
| SC (310/140) | 6% | 27% | 35% | — | 40% |

Similar to the permeability, the EPDM stands out from the other elastomers, which is possibly due to its deviating non-polar chemistry. While swelling goes up to only 10% for EPDM, the elastomers with more polarized bonds yield much higher swelling with $CO_2$. In addition, a large variance is identified in the supercritical swelling behavior. However, the public data may not be reliable in relation to present day versions of the elastomers. Nonetheless, it seems that swellability is increased, which matches with the general notion that the solvability of supercritical $CO_2$ increases while viscosity remains equal to gas phase $CO_2$.

Besides the number of cross links—mentioned above—the performance of the elastomer is also influenced by the type of chemistry used for cross linking. Although historically 'vulcanization' of natural rubber (elastomers) was done by sulfur addition, the elastomers under review here are commonly crosslinked with i) amine or ii) peroxide crosslinks. One study indicates that FKM with peroxy linkers swells more when compared to FKM with amine linkers. Table 4 shows $CO_2$ absorption data from publicly available sources for selected elastomer/crosslinker combinations. FKM(1) is based on Viton A (DuPont/Chemours, 66% F) and the FKM(2) is based on Tecnoflon (Solvay, 64% F).

TABLE 4

| Abbr. name | Cross link | $CO_2$ absorption (%) |
|---|---|---|
| FKM(1) | Amine | 29.5 |
| FKM(2) | Peroxy | 40.5 |
| EPDM | Peroxy | 9.3 |
| FEPM | Peroxy | 36.8 |

In one example, the $CO_2$ swellable seal may be applied to a wellbore tubular in the manner as described in WO 2019/238566 A, which is incorporated herein in its entirety. As illustrated in FIG. 1, the seal 2 may thus be applied in the form of an elastomer sleeve that snugly fits to an outside surface of the wellbore tubular 1 after at least partly relaxing the elastically stretching force that was applied during installation of the sleeve on the wellbore tubular 1. The wellbore tubular 1 extends into a borehole 10 in an Earth formation 8. The borehole 10 may be a wellbore. A cement sheath 7 may be provided on the outside of the wellbore tubular 1, which fully surrounds the elastomer sleeve. This may be achieved by pumping cement on the outside of the wellbore tubular, whereby fully surrounding the elastomer sleeve.

Figure 2:
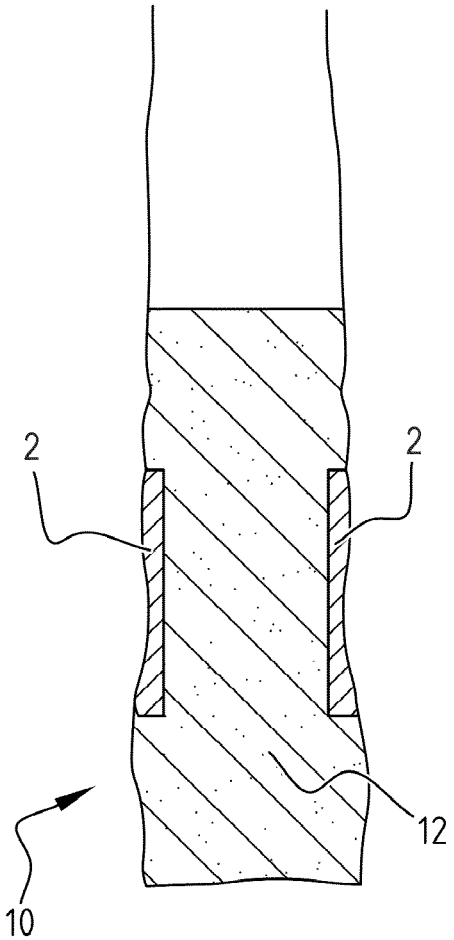
FIG. 2 schematically shows a cross sectional view of a wellbore cladded with a downhole elastomer seal.

In another example, illustrated in FIG. 2, the $CO_2$ swellable seal 2 may be applied inside a borehole 10, or inside a wellbore tubular, for example in the manner as disclosed in US 2019/0211642 A, which is incorporated herein in its entirety. After cladding the inner surface of the borehole 10 (which may be uncased, or be lined with a wellbore tubular such as a casing tubular) with the seal, a well bore plugging material, such as cement, may be inserted into the seal 2 and allowed to harden and form a plug 12. The seal then forms a swellable sealing layer between the plug and the inner surface against which it was cladded.

In another example, the $CO_2$ swellable seal may be applied in a swellable packer.

When the elastomer is confined, for example between a wellbore tubular and cement, any swelling will be limited by the space available. For instance, an EPDM layer of 2 mm thick would swell by approximately 200 μm, whereas FKM would swell over 0.5 mm. Depending on precise specifications, the swelling of e.g. EPDM could therefore be sufficient despite the relatively slow swellability. If the swelling can be confined, the permeability of the elastomer can be lowered as well, since the permeability is directly related to the $CO_2$ solubility (swelling) and diffusion. Studies for HNBR indicate that lower $CO_2$ dissolution also lowers the diffusion. Hence, the permeability may be lowered for a confined elastomer seal. The opposite may also hold true: for a seal that is not at all confined, the highest permeability should be expected.

Figure 3:
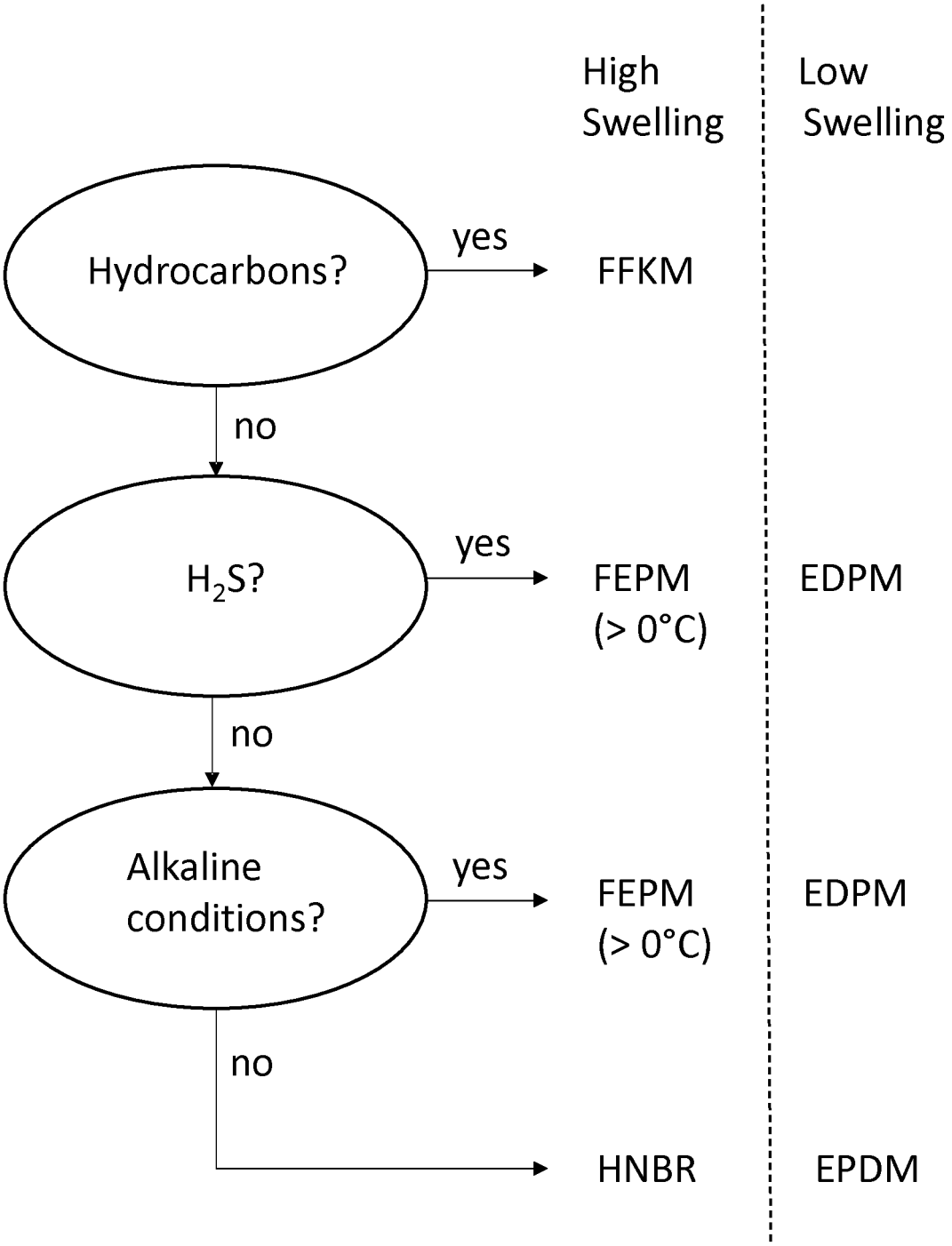
FIG. 3 schematically shows a selection tree for selecting a suitable elastomer.

FIG. 3 shows a decision tree which can be used in a method of selecting the elastomer for a specific application as swellable seal in subsurface $CO_2$ storage. It can be seen that no low swelling option is presently available for environments which contain hydrocarbons, such as more than 4% by volume of hydrocarbons.

The elastomer may be spiked with an additive compound, which is capable of engaging in a precipitation reaction with water and/or $CO_2$ whereby growing the solid molar fraction of solids within the downhole seal. Preferably, the solids grown this way are not soluble in water or other wellbore fluids that are prevalent downhole. This enhances the long-term sealing capability.

It has been found that metal oxides, particularly a selection of alkaline earth metal oxides, can be applied as inclusions in the elastomer. Suitable alkaline earth metal oxides may include at least MgO, CaO, SrO, and BaO. Calcium oxide (CaO) has particular potential as it is a cost-effective choice.

Taking CaO as (non-limiting) example, upon exposure to $CO_2$, for example after possible ingress of carbon dioxide into the elastomer material, CaO inclusions can chemically react with the $CO_2$ whereby forming solid carbonates:

$$CaO_{(s)}+CO_{2(ag)}\rightarrow CaCO_{3(s)}.$$

Furthermore, upon exposure to water, CaO inclusions can hydrate whereby forming calcium hydroxide:

$$CaO_{(s)}+H_2O_{(l)}\rightarrow Ca(OH)_{2(s)}.$$

This reaction product, in turn, is can chemically react with the $CO_2$ whereby forming solid carbonates:

$$Ca(OH)_{2(s)}+CO_{2(ag)}\rightarrow CaCO_{3(s)}+H_2O_{(l)}.$$

Each of these reactions above involve an increase in solid volume. For direct carbonation of CaO, this increase constitutes about 20.1 $cm^3$ per mol of CaO converted (120% solid volume increase, i.e. more than doubling the volume). For conversion of calcium hydroxide to calcium carbonate, the solid volume change of reaction is about 3.4 $cm^3$ per mol of $Ca(OH)_2$ converted (10% solid volume increase). This increase in solid volume imparts an additional swelling effect of the elastomer body upon specific exposure to carbon dioxide. These solid (precipitating) carbonate reaction products have a relatively low solubility, enhancing the ability of the elastomer material to prevent migration of these compounds out of the swellable elastomer body.

The hydration reaction also involves an increase in solid volume, gaining about 16.7 $cm^3$ per mol of CaO converted (~99.6% solid volume increase, i.e. almost a doubling of solid volume), thereby causing additional swelling of the elastomer seal compared to seals that have not been spiked this way. It is therefore preferred that the elastomer seal is hygroscopic, in order to attract water to promote the hydration reaction. This may suitably be achieved by adding a salt to the elastomer material, which salt may be hydroscopic and soluble in water. Sodium chloride (NaCl) and calcium chloride ($CaCl_2$)) are good low-cost choices, but many other salts can be used as well.

Hygroscopic properties of the elastomer seal may also be beneficial in attracting $CO_2$ dissolved in water (aqueous phase). As $CO_2$ dissolved in water (aqueous phase) causes the water to become acidic, the subsequent carbonation reactions will be promoted by an alkaline nature of the inclusions.

The low solubility of the reaction product will help restrict the migration of the compound out of the swellable polymer body.

In addition to calcium oxide, magnesium oxide may have specific potential for the purpose described above, for example when volume increase is a limiting factor. MgO is expected to react slower than CaO, but the solid volume increase of the hydration reaction is larger than with CaO. This may further enhance the longevity of the swelling effect.

Furthermore, the presence of earth alkaline oxides and earth alkaline hydroxides in the elastomeric material will result in highly alkaline conditions (pH>10) and therefore chemically more compatible with concrete cements such as Portland cement which may be in close contact with the elastomer in the downhole use.

The metal oxide inclusions may be mixed into the elastomer mass, prior to vulcanization, in a moulding apparatus, in the same manner as described for salt particles in e.g. U.S. Pat. No. 7,527,099. Compound preparation is considered to be within the common general knowledge of the person skilled in the art, as evidenced by e.g. Werner Hofmann, Rubber Technology Handbook, 2nd ed. (1996), Hanser/Gardner Publications, Cincinnati, ISBN 1-56990-145-7 Chapter 5: Processing of elastomers, Compound Preparation.

The person skilled in the art will understand that the present invention can be carried out in many various ways without departing from the scope of the appended claims.

The invention claimed is:

1. A downhole seal, comprising:

a $CO_2$ swellable elastomer which swells when in contact with $CO_2$, wherein the $CO_2$ swellable elastomer comprises a salt that is hydroscopic and soluble in water.

2. The downhole seal of claim 1, wherein the $CO_2$ swellable elastomer comprises a halogenated elastomer.

3. The downhole seal of claim 1, wherein the $CO_2$ swellable elastomer comprises a perhalogenated elastomer.

4. The downhole seal of claim 1, the $CO_2$ swellable elastomer comprises EPDM.

5. The downhole seal of claim 1, which is mechanically confined in a space before swelling.

6. The downhole seal of claim 1, wherein the $CO_2$ swellable elastomer comprises inclusions comprising a metal oxide.

7. The downhole seal of claim 6, wherein the metal oxide is susceptible to chemically react with $CO_2$.

8. The downhole seal of claim 6, wherein the metal oxide is susceptible to chemically react with water.

9. The downhole seal of claim 8, wherein a reaction product from a chemical reaction of the metal oxide with water is susceptible to chemically react with $CO_2$.

10. The downhole seal of claim 6, wherein the metal oxide is an alkaline earth metal oxide.

11. A method of setting a downhole seal, comprising:

installing a downhole seal comprising a $CO_2$ swellable elastomer in a downhole location within a borehole and exposing the downhole seal to contact with $CO_2$ after said installing, wherein the $CO_2$ swellable elastomer comprises a salt that is hydroscopic and soluble in water, whereby the $CO_2$ causes the downhole seal to swell.

12. The method of claim 11, wherein a concentration of hydrocarbons in said $CO_2$ is below 4% by volume.

13. The method of claim 11, wherein the $CO_2$ swellable elastomer comprises inclusions comprising a metal oxide.

14. The method of claim 13, wherein the metal oxide is susceptible to chemically react with $CO_2$, further comprising allowing a chemical reaction between the metal oxide and $CO_2$ in contact with the metal oxide whereby forming a carbonate which precipitates in a solid phase within the downhole seal.

15. The method of claim 13, wherein the metal oxide is susceptible to chemically react with water, further comprising allowing a hydration chemical reaction between the metal oxide and water in contact with the metal oxide whereby forming a reaction product which, in turn, is susceptible to chemically react with $CO_2$, said method further comprising allowing a carbonation reaction between the reaction product and $CO_2$ in contact with the reaction product whereby forming said carbonate which precipitates in a solid phase within the downhole seal.

16. The method of claim 13, wherein the metal oxide is an alkaline earth metal oxide.

* * * * *